US006069123A

United States Patent [19]

Masotti et al.

[11] Patent Number: 6,069,123

[45] Date of Patent: May 30, 2000

[54] PEROXYGEN BLEACH-CONTAINING PRESPOTTING COMPOSITIONS WITH POLYAMINE STABILIZERS PROVIDING IMPROVED FABRIC/COLOR SAFETY

[75] Inventors: Valentina Masotti, Casalecchio di Reno; Stefano Scialla, Rome, both of Italy

[73] Assignee: Procter & Gamble Company, Cincinnati, Ohio

[21] Appl. No.: 08/981,616

[22] PCT Filed: Jun. 3, 1996

[86] PCT No.: PCT/US96/10234

§ 371 Date: Dec. 23, 1997

§ 102(e) Date: Dec. 23, 1997

[87] PCT Pub. No.: WO97/02332

PCT Pub. Date: Jan. 23, 1997

[30] Foreign Application Priority Data

Jun. 30, 1995 [EP] European Pat. Off. ..... 95870079

[51] Int. Cl.[7] ..... C11D 3/30; C11D 3/395

[52] U.S. Cl. ..... 510/284; 510/283; 510/303; 510/312; 510/340; 510/341; 510/342; 510/372; 510/417; 510/488; 510/499

[58] Field of Search ..... 510/283, 303, 510/309, 340, 372, 417, 499, 284, 312, 341, 342, 488; 8/111; 252/186.26, 186.27, 186.28, 186.29, 186.38, 186.41, 401

[56] References Cited

U.S. PATENT DOCUMENTS

| | | | |
|---|---|---|---|
| 4,885,156 | 12/1989 | Kotilainen et al. | 424/54 |
| 4,900,468 | 2/1990 | Mitchell et al. | 8/111 |
| 4,959,075 | 9/1990 | Baehr et al. | 8/111 |
| 5,180,514 | 1/1993 | Farr et al. | 8/111 |
| 5,409,632 | 4/1995 | Showell et al. | 252/186.26 |
| 5,616,281 | 4/1997 | Hardy et al. | 252/186.38 |

FOREIGN PATENT DOCUMENTS

| | | |
|---|---|---|
| 369841 | 5/1990 | European Pat. Off. . |
| 414581 | 2/1991 | European Pat. Off. . |
| 3919551 | 1/1990 | Germany . |
| 1-162866 | 6/1989 | Japan . |
| 2-84497 | 3/1990 | Japan . |
| 6-41525 | 2/1994 | Japan . |

OTHER PUBLICATIONS

English language translation of JP 1–162,866, Kao Corp, pp. 1–10, Jun. 1989.

Enlgish language translation of JP 2–84,497, Kao Corp, pp. 1–11, Mar. 1990.

English Language translation of EP 369,841, Camp Fabrica de Jabones Co, pp. 1–16, May 1990.

English language translation of EP 414,581, Camp Fabrica de Jabones Co, pp. 1–25, Feb. 1991.

CAPLUS Abstract of FR 2140822, Air Liquide, Jan. 1973.

DWPI Abstract of FR 2140822, Air Liquide, Jan. 1973.

*Primary Examiner*—Caroline D. Liott

*Attorney, Agent, or Firm*—C. Brant Cook; Kim W. Zerby; Jacobus C. Rasser

[57] ABSTRACT

The present invention relates to liqiuid compositions comprising a peroxygen bleach and a specific polyamine, or mixtures thereof. The present invention further encompasses a process for pretreating soiled fabrics and/or soiled colored fabrics, for reducing the color damage of said colored fabrics and/or for reducing the loss of tensile strength in said fabrics.

15 Claims, No Drawings

PEROXYGEN BLEACH-CONTAINING PRESPOTTING COMPOSITIONS WITH POLYAMINE STABILIZERS PROVIDING IMPROVED FABRIC/COLOR SAFETY

TECHNICAL FIELD

The present invention relates to stable peroxygen bleach-containing compositions suitable to be used as pretreater.

BACKGROUND

Peroxygen bleach-containing compositions have been extensively described in laundry applications as laundry detergents, laundry additives or even laundry pretreaters.

Indeed, it is known to use such liquid peroxygen bleach-containing compositions in laundry pretreatment applications to boost the removal of encrustated stains/soils which are otherwise particularly difficult to remove such as grease, coffee, tea, grass, mud/clay-containing soils and the like. However, a drawback associated with such liquid peroxygen bleach-containing compositions is the relative instability of said compositions. Indeed, such liquid peroxygen bleach-containing compositions when packaged in containers made out of deformable materials, typically thermoplastic materials, may cause so-called bulging problems. The peroxide bleach in the composition decomposes with time so as to generate oxygen in the composition. The released oxygen builds up pressure inside the container which eventually deforms, i.e., bulges. The rate of decomposition of peroxygen bleach depends on different parameters such as temperature, pH and/or presence of metal ions.

Known solutions to this problem are to use in such peroxygen bleach-containing compositions metal ions chelating agents, e.g., polyaminocarboxylates and/or phosphonate chelating agents, and/or radical scavengers which contribute to reduce peroxygen bleach decomposition and thus to stabilise said compositions.

Representative of the art is for example, EP-B- 209 228, which discloses the use of metal ions chelating agents such as amino polyphosphonates and radical scavengers such as hydroxybenzene compounds (butylated hydroxy toluene) to stabilise liquid hydrogen peroxide bleaching compositions.

However, such liquid peroxygen bleach-containing compositions are not totally satisfactory from a formulator point of view as said compositions all the same tend to be somewhat chemically unstable and consequently all the same tend to bulge the containers into which they may be packaged. In other words, it has been found that there is still room for further improving the chemical stability of a liquid peroxygen bleach-containing composition.

It is thus an object of the present invention to formulate liquid peroxygen bleach-containing compositions which exhibit improved chemical stability, especially upon prolonged periods of time.

It is further desirable when formulating peroxygen bleach-containing compositions suitable to be used as pretreater, that said compositions are safe to said fabric treated therewith. Indeed, it has been found that a drawback associated with such peroxygen bleach-containing compositions is that said compositions may damage fabrics, resulting in loss of tensile strength of the fabric fibres and/or color damage, when used in pretreatment application under stressed conditions, e.g., when applied directly onto the fabrics, and left to act onto said fabrics for prolonged periods of time, i. e., several hours, before washing said fabrics and/or when the fabrics to be pretreated are contaminated with metal ions such as copper and/or iron and/or manganese and/or chromium. Indeed, it is speculated that the presence of metal ions such as copper and/or iron and/or manganese and/or chromium on the surface of the fabrics, especially on cellulosic fibres, catalyses the radical decomposition of peroxygen bleaches like hydrogen peroxide. Thus, it is believed that a radical reaction occurs on the surface of the fabric with generation of free radicals, which results in tensile strength loss. Furthermore, it is speculated that this generation of free radicals may further provide an aggressive decomposition of certain dyes present in the fabrics resulting thereby in chemical damage of dye molecules which is visible as discoloration and/or hue change. Dyes commonly present in colored fabrics include metal containing dyes like copper-formazan dyes or metal-azo dyes.

Therefore we have found essential that this surface reaction resulting in generation of free radicals is controlled in the pretreatment environment, thereby providing improved safety to fabrics and colors.

It has now been found that this can be achieved by adding to a peroxygen bleach-containing composition a specific polyamine or mixtures thereof. Indeed, it has been unexpectedly found that the addition of a polyamine as defined hereinafter, or mixtures thereof, allows to dramatically reduce the decomposition of peroxygen bleaches like hydrogen peroxide, even under stressed conditions like prolonged exposure at high temperature, for example at 50° C. during 20 days. More particularly, it has been found that the use of said polyamine, or mixtures thereof, in a peroxygen bleach-containing composition, delivers improved chemical stability to said composition as well as improved fabric safety and/or improved color safety to fabrics pretreated with said composition, this both when used alone or in combination with other bleach stabilisers like chelating agents and/or radical scavengers. Indeed, it is believed that this stabilising effect and fabric safety properties are matrix independent.

Actually, there is an optimum concentration for each of the chelating agents and/or radical scavengers used in peroxygen bleach-containing compositions which delivers the maximum benefits in terms of peroxygen bleach stability. For example in a peroxygen bleach-containing composition comprising about 10% by weight of peroxygen bleach or less, the optimum concentration of a well-known chelating agent like s,s, ethylenediamine N,N'-disuccinic acids (ssEDDS), or diethylene triamine pentamethylene phosphonates or diethylene triamine pentaacetates (DTPA) is around 0.01% to 0.3% by weight of the total composition of said chelating agent. In other words, it has been observed that by further increasing the optimum concentration for peroxygen bleach stability of said chelating agent in a peroxygen bleach-containing composition, said composition becomes less chemically stable, i.e. the peroxygen bleach decomposition increases. Additionally, it has been observed that by combining different chelating agents at their optimum concentration for peroxygen bleach stability, the peroxygen stability does not increase on the contrary such combinations usually contribute to decreasing the peroxygen stability. It has now unexpectedly been found that the present invention allows to use a specific polyamine, or mixtures thereof, in combination with other bleach stabilizer like chelating agents and/or radical scavengers and to provide thereby peroxygen bleach compositions with improved chemical stability.

An advantage of the present invention is that excellent laundry performance on a broad range of stains and soils such as bleachable stains and/or greasy stains.

Another advantage of the present invention is that the compositions of the present invention provide also excellent performance when used in other applications, apart from laundry pretreater application, such as in other laundry applications, as a laundry detergent or laundry additive, or even in hard surface cleaning applications or in carpet cleaning applications.

SUMMARY OF THE INVENTION

The present invention encompasses a liquid composition comprising a peroxygen bleach and a polyamine as defined hereinafter, or mixtures thereof.

The present invention further encompasses a process of pretreating soiled fabrics with a liquid composition comprising a peroxygen bleach and a polyamine as defined hereinafter, or mixtures thereof, and said process comprises the steps of applying said composition in its neat form onto the fabric and allowing said composition to remain in contact with said fabric, before said fabric is washed.

DETAILED DESCRIPTION OF THE INVENTION

The present invention is a liquid composition comprising a peroxygen bleach and a specific polyamine, or mixtures thereof.

As an essential element the compositions of the present invention comprise a peroxygen bleach. Preferred peroxygen bleach is hydrogen peroxide, or a water soluble source thereof, or mixtures thereof. Hydrogen peroxide is most preferred to be used in the compositions of the present invention. Indeed, the presence of peroxygen bleach, preferably hydrogen peroxide, provides strong cleaning benefits which are particularly noticeable in laundry applications. As used herein a hydrogen peroxide source refers to any compound which produces hydrogen peroxide when said compound is in contact with water.

Suitable water-soluble sources of hydrogen peroxide for use herein include percarbonates, persilicate, persulphate such as monopersulfate, perborates, peroxyacids such as diperoxydodecandioic acid (DPDA), magnesium perphtalic acid, perbenzoic and alkylperbenzoic acids, and mixtures thereof.

Typically, the compositions of the present invention comprise from 0.01% to 90% by weight of the total composition of said peroxygen bleach, preferably from 2% to 20% and most preferably from 3% to 10%.

As a second essential ingredient, the compositions of the present invention comprise a polyamine having one of the following general structures, or mixtures thereof:

$NH_2—(CH_2—CH_2—NH)_n—CH_2—CH_2—NH_2$ wherein n is an integer of from 0 to 15, preferably of from 0 to 10 and more preferably of from 0 to 5 or, $NH_2—[(CH_2—CH_2—NH)_n(CH_2—CH_2—CH_2—NH)_m]CH_2—CH_2—NH_2$ wherein n is an integer of from 0 to 8, preferably of from 0 to 3 and m is an integer of from 0 to 8, preferably of from 0 to 3, or $C_nH_{2n+2-m}(NH2)_m$ wherein n is an integer of from 2 to 20, preferably of from 2 to 10 and more preferably of from 2 to 5 and m is an integer of from 2 to 4, preferably is 2, or $C_nH_{2n-m}(NH2)_m$ wherein n is an integer of from 2 to 20, preferably of from 2 to 10 and more preferably of from 2 to 6 and m is an integer of from 2 to 4, preferably is 2, or $C_nH_{2n-2-m}(NH2)_m$ wherein n is an integer of from 3 to 20, preferably of from 3 to 10 and more preferably of from 3 to 5 and m is an integer of from 2 to 4, preferably is 2, or $C_nH_{2n-4-m}(NH2)_m$ wherein n is an integer of from 4 to 20, preferably of from 4 to 10 and more preferably of from 4 to 6 and m is an integer of from 2 to 4, preferably is 2, or $C_nH_{2n-6-m}(NH2)_m$ wherein n is an integer of from 5 to 20, preferably of from 5 to 10 and more preferably of from 5 to 7 and m is an integer of from 2 to 4, preferably is 2.

It is to be understood that, in the chemical formula $NH_2—[(CH_2—CH_2—NH)_n(CH_2—CH_2—CH_2—NH)_m]CH_2—CH_2—NH_2$, the groups $(CH2\text{-}CH2\text{-}NH)_n$ and $(CH2\text{-}CH2\text{-}CH2\text{-}NH)_m$ may appear in any sequence in the molecule.

Accordingly suitable polyamine or mixtures thereof to be used herein include alkyl polyamines in general, such as 1,2 alkyl diamine, e.g, 1,2 propyl-diamine, 1,3 alkyl diamine, e.g., 1,3 propyl-diamine, 1,4 alkyl diamine, e.g., 1,4 butyl-diamine, propylene diamine, isopropylene diamine, ethylene diamine. Highly preferred polyamine to be used herein is ethylene diamine (EDA).

The polyamines suitable to be used herein may be available from Union Carbide. For example ethylene diamine may be commercially available under the name EDA® from Union Carbide.

Typically, the compositions of the present invention comprise from 0.01% to 5.0% by weight of the total composition of said polyamine, or mixtures thereof, preferably from 0.1% to 3.0% and most preferably from 0.4% to 1.5%.

The peroxygen bleach-containing compositions of the present invention are chemically stable. By "chemically stable" it is meant herein that a composition of the present invention comprising a peroxygen bleach does not undergo more than 10% available oxygen loss at 50° C. in 2 weeks. The concentration of available oxygen can be measured by chemical titration methods known in the art, such as the iodimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

Alternatively the stability of the compositions may also be evaluated by a bulging test method as described herein after in the experimental data.

The present invention is based on the finding that, peroxygen bleach decomposition is reduced in a peroxygen bleach-containing composition of the present invention comprising a polyamine, as defined herein, or mixtures thereof, thereby preventing the bulging of a deformable container containing it, as compared to the same composition but without said polyamine or mixtures thereof. By "deformable container" it is meant herein any closable container commonly used in the art to package detergent compositions like pretreaters and that can bulge under the pressure generated inside. Such containers include those made of thin metal materials like aluminium sheets or/and of thermoplastic materials (single layer or multilayer materials) including virgin and recycled materials and mixtures thereof, vinyl chloride based resins, polymers and copolymers derived from olefines, acrylic polymers and copolymers, polyethylene, polypropylene, polystyrene, polyethylene terephthalate, or mixtures thereof.

Accordingly a peroxygen bleach-containing composition of the present invention may be packaged in a given deformable container/bottle without compromising the stability of said container/bottle comprising it upon standing, for longer periods of time, as would otherwise be possible by packaging in said given container/bottle the same composition but without said polyamine as defined herein, or mixtures thereof.

The present invention is further based on the finding that on top of the improved peroxygen stability properties delivered by the peroxygen bleach-containing compositions of the present invention comprising a polyamine as defined herein, or mixtures thereof, said compositions when used to pretreat soiled fabrics also deliver improved fabric safety, as compared to the use of the same compositions but without said polyamine, or mixtures thereof, to pretreat said fabrics. Indeed, the use of a peroxygen bleach-containing composition comprising a polyamine as defined herein, or mixtures thereof, allows to considerably reduce the tensile strength loss of a fabric pretreated therewith, even if said composition is left onto said fabric upon a prolonged period of time before washing said fabric, e.g. about 24 hours or more, and said fabric is contaminated by high levels of metal ions such as copper and/or iron and/or manganese, e.g. 30 ppm of copper or more per gram of fabric.

The tensile strength loss of a fabric may be measured by employing the Tensile Strength method, as can be seen in the examples herein after. This method consists in measuring the tensile strength of a given fabric by stretching said fabric until it breakes. The force, expressed in Kg, necessary to break the fabric is the "Ultimate Tensile Stress" and may be measured with "The Stress-Strain INSTRON Machine". By "tensile strength loss" it is to be understood the difference when comparing the tensile strength of a fabric taken as a reference, i.e., a fabric which has not been pre-treated, and the tensile strength of the same fabric after having been pre-treated according to the present invention. A tensile strength loss of zero means that no fabric damage is observed.

The present invention is further based on the finding that on top of the improved peroxygen stability properties delivered by the peroxygen bleach-containing compositions of the present invention comprising a polyamine as defined herein, or mixtures thereof, said compositions when used to pretreat soiled colored fabrics also deliver improved color safety, as compared to the use of the same compositions but without said polyamine, or mixtures thereof, to pretreat said fabrics. Indeed, the use of a peroxygen bleach-containing composition comprising a polyamine as defined herein, or mixtures thereof, allows to considerably reduce the color change and/or decoloration of colored fabrics pretreated therewith, even if said composition is left onto said colored fabrics upon a prolonged period of time before washing said colored fabrics, e.g. about 24 hours or more.

Also fabric tensile strength loss reduction and/or fabric color damage reduction are obtained with liquid compositions of the present invention without compromising on the bleaching performance nor on the stain removal performance delivered by said compositions.

The compositions according to the present invention are aqueous liquid cleaning compositions. Said aqueous compositions should be formulated in the acidic pH, preferably at a pH of from 0 to 6 and more preferably at a pH of from 2 to 5. Formulating the compositions of the present invention in the acidic pH range contributes to the stability of said compositions. The pH of the compositions of the present invention can be adjusted by using organic or inorganic acids, or alkalinising agents.

The present invention encompasses raw material compositions, i.e. compositions based essentially on peroxygen bleach and comprising a polyamine, as defined herein or mixtures thereof, as well as fully formulated detergent compositions, i.e. compositions incorporating further ingredients commonly used in detergent field like other stabiliser, chelating agents, radical scavengers, surfactants, bleach activators, builders, soil suspenders, dye transfer agents, solvents, brighteners, perfumes, foam suppressors or dyes or mixtures thereof.

The peroxygen bleach-containing compositions of the present invention may comprise a chelating agent or mixtures thereof, as a highly preferred optional ingredient. Chelating agents suitable to be used herein include chelating agents selected from the group of phosphonate chelating agents, amino carboxylate chelating agents, polyfunctionally-substituted aromatic chelating agents, and further chelating agents like glycine, salicylic acid, aspartic acid, glutamic acid, malonic acid, or mixtures thereof.

Suitable phosphonate chelating agents to be used herein may include ethydronic acid as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates. Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy -3,5-disulfobenzene.

A preferred biodegradable chelating agent for use herein is ethylene diamine N,N'- disuccinic acid, or alkali metal, or alkaline earth, ammonium or substitutes ammonium salts thereof or mixtures thereof. Ethylenediamine N,N'- disuccinic acids, especially the (S,S) isomer have been extensively described in U.S. Pat. No. 4,704,233, Nov. 3, 1987. to Hartman and Perkins. Ethylenediamine N,N'- disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA),N-hydroxyethylethylenediamine triacetates, nitrilotriacetates, ethylenediamine tetrapropionates, triethylenetetraaminehexaacetates, ethanoldiglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Particularly preferred chelating agents to be used herein are diethylene triamine methylene phosphonate, ethylene N,N'-disuccinic acid, diethylene triamine pantaacetate, glycine, salicylic acid, aspartic acid, glutamic acid, malonic acid or mixtures thereof and highly preferred is salicylic acid. Salicylic acid may be commercially available from Rhone-Poulenc under the name Salicylic Acid®.

The peroxygen bleach-containing compositions of the present invention may further comprise a radical scavenger, or mixtures thereof, as a highly preferred optional ingredient. Suitable radical scavengers for use herein include the well-known substituted mono and di hydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene.

The peroxygen-bleach containing compositions of the present invention may further comprise any surfactant known to those skilled in the art including nonionic, anionic, cationic, zwitterionic or amphotheric surfactants or mixtures thereof.

The peroxygen-bleach containing compositions of the present invention may also comprise a liquid hydrophobic bleach activator, as a highly preferred optional ingredient. By bleach activator, it is meant herein a compound which reacts with hydrogen peroxide to form a peracid. The peracid thus formed constitutes the activated bleach. By "hydrophobic bleach activator", it is meant herein an activator which is not substantially and stably miscible with water. Typically, such hydrophobic bleach activators have an HLB of below 11. Such suitable liquid hydrophobic bleach activators typically belong to the class of esters, amides, imides, or anhydrides. A particular family of bleach activators of interest was disclosed in EP 624 154, and particularly preferred in that family is acetyl triethyl citrate (ATC). ATC has the other advantages that it is environmentally friendly in that it eventually degrades into citric acid and alcohol. Also, ATC has good hydrolytical stability in the compositions herein, and it is an efficient bleach activator. Finally, it provides good building capacity to the compositions. It is also possible to use mixtures of liquid hydrophobic bleach activators herein. The compositions herein where a bleach activator is present should comprise from 0.5% to 20% by weight of the total composition of said bleach activator, preferably from 2% to 10%, most preferably from 3% to 7%.

When the peroxygen bleach-containing compositions according to the present invention further comprise a liquid hydrophobic bleach activator it is highly desired herein for stability purpose to formulate said compositions either as aqueous emulsions of surfactants which comprise said liquid hydrophobic bleach activator, or as microemulsions of said liquid hydrophobic bleach activator in a matrix comprising water, the peroxygen bleach and a hydrophilic surfactant system comprising an anionic and a nonionic surfactant.

In the embodiment of the present invention where the peroxygen bleach-containing compositions of the present invention are formulated as aqueous emulsions, said peroxygen bleach-containing emulsions comprise a surfactant system of at least two different surfactants, i.e. at least a hydrophobic surfactant having an HLB up to 9 and at least a hydrophilic surfactant having an HLB above 10 in order to emulsify the liquid hydrophobic bleach activator. Indeed, said two different surfactants in order to form emulsions which are stable must have different HLB values (hydrophilic lipophilic balance), and preferably the difference in value of the HLBs of said two surfactants is at least 1, preferably at least 3. In other words, by appropriately combining at least two of said surfactants with different HLBs in water, stable emulsions will be formed, i.e. emulsions which do not substantially separate into distinct layers, upon standing for at least two weeks at 50° C.

The emulsions according to the present invention comprise from 2% to 50% by weight of the total composition of said hydrophilic and hydrophobic surfactants, preferably from 5% to 40% and more preferably from 8% to 30%. The emulsions according to the present invention comprise at least from 0.1% by weight of the total emulsion of said hydrophobic surfactant, or mixtures thereof, preferably at least 3% and more preferably at least 5% and at least from 0.1% by weight of the total emulsion of said hydrophilic surfactant, or mixtures thereof, preferably at least 3%, and more preferably at least 6%.

Preferred to be used herein are the hydrophobic nonionic surfactants and hydrophilic nonionic surfactants. Said hydrophobic nonionic surfactants to be used herein have an HLB up to 9, preferably below 9, more preferably below 8 and said hydrophilic surfactants have an HLB above 10, preferably above 11, more preferably above 12. Indeed, the hydrophobic nonionic surfactants to be used herein have excellent grease cutting properties, i.e. they have a solvent effect which contributes to hydrophobic soils removal. The hydrophobic surfactants act as carrier of the hydrophobic brighteners onto the fabrics allowing thereby said brighteners to work in close proximity with the fabrics surface since the beginning of the wash.

Suitable nonionic surfactants for use herein include alkoxylated fatty alcohols preferably, fatty alcohol ethoxylates and/or propoxylates. Indeed, a great variety of such alkoxylated fatty alcohols are commercially available which have very different HLB values (hydrophilic lipophilic balance). The HLB values of such alkoxylated nonionic surfactants depend essentially on the chain length of the fatty alcohol, the nature of the alkoxylation and the degree of alkoxylation. Hydrophilic nonionic surfactants tend to have a high degree of alkoxylation and a short chain fatty alcohol, while hydrophobic surfactants tend to have a low degree of alkoxylation and a long chain fatty alcohol. Surfactants catalogs are available which list a number of surfactants including nonionics, together with their respective HLB values.

Suitable chemical processes for preparing the nonionic surfactants for use herein include condensation of corresponding alcohols with alkylene oxide, in the desired proportions. Such processes are well known to the man skilled in the art and have been extensively described in the art. As an alternative, a great variety of alkoxylated alcohols suitable for use herein is commercially available from various suppliers.

Preferred hydrophobic nonionic surfactants to be used in the emulsions according to the present invention are surfactants having an HLB up to 9 and being according to the formula $RO—(C_2H_4O)_n(C_3H_6O)_mH$, wherein R is a $C_6$ to $C_{22}$ alkyl chain or a $C_6$ to $C_{28}$ alkyl benzene chain, and wherein n+m is from 0.5 to 5 and n is from 0 to 5 and m is from 0 to 5 and preferably n+m is from 0.5 to 4 and, n and m are from 0 to 4. The preferred R chains for use herein are the $C_8$ to $C_{22}$ alkyl chains. Accordingly suitable hydrophobic nonionic surfactants for use herein are Dobanol$^R$ 91–2.5 (HLB=8.1; R is a mixture of $C_9$ and $C_{11}$ alkyl chains, n is 2.5 and m is 0), or Lutensol$^R$ TO3 (HLB=8; R is a mixture of $C_{13}$ and $C_{15}$ alkyl chains, n is 3 and m is 0), or Tergitol$^R$ 25L3 (HLB=7.7; R is in the range of $C_{12}$ to $C_{15}$ alkyl chain length, n is 3 and m is 0), or Dobanol$^R$ 23–3 (HLB=8.1; R is a mixture of $C_{12}$ and $C_{13}$ alkyl chains, n is 3 and m is 0), or Dobanol$^R$ 23–2 (HLB=6.2; R is a mixture Of $C_{12}$ and $C_{13}$ alkyl chains, n is 2 and m is 0), or mixtures thereof. Preferred herein are Dobanol$^R$ 23–3, or Dobanol$^R$ 23–2, Lutensol$^R$ TO3, or mixtures thereof. These Dobanol$^R$ surfactants are commercially available from SHELL. These Lutensol$^R$ surfactants are commercially available from BASF and these Tergitol $^R$ surfactants are commercially available from UNION CARBIDE. Other suitable hydrophobic nonionic surfactants to be used herein are non alkoxylated surfactants. An example is Dobanol $^R$ 23 (HLB<3).

Preferred hydrophilic nonionic surfactants to be used in the emulsions according to the present invention are surfactants having an HLB above 10 and being according to the formula RO—$(C_2H_4O)_n(C_3H_6O)_mH$, wherein R is a $C_6$ to $C_{22}$ alkyl chain or a $C_6$ to $C_{28}$ alkyl benzene chain, and wherein n+m is from 5 to 11 and n is from 0 to 11 and m is from 0 to 11, preferably n+m is from 6 to 10 and, n and m are from 0 to 10. Throughout this description n and m refer to the average degree of the ethoxylation/propoxylation. The preferred R chains for use herein are the $C_8$ to $C_{22}$ alkyl chains. Accordingly suitable hydrophilic nonionic surfactants for use herein are Dobanol $^R$ 23–6.5 (HLB=11.9; R is a mixture of $C_{12}$ and $C_{13}$ alkyl chains, n is 6.5 and m is 0), or Dobanol $^R$ 25–7 (HLB=12; R is a mixture of $C_{12}$ to $C_{15}$ alkyl chains, n is 7 and m is 0), or Dobanol $^R$ 45–7 (HLB=11.6; R is a mixture of $C_{14}$ and $C_{15}$ alkyl chains, n is 7 and m is 0), or Dobanol $^R$ 91–5 (HLB=11.6; R is a mixture of $C_9$ to $C_{11}$ alkyl chains, n is 5 and m is 0), or Dobanol $^R$ 91–6 (HLB=12.5; R is a mixture of $C_9$ to $C_{11}$ alkyl chains, n is 6 and m is 0), or Dobanol $^R$ 91–8 (HLB=13.7; R is a mixture of $C_9$ to $C_{11}$ alkyl chains, n is 8 and m is 0), or Dobanol $^R$ 91–10 (HLB=14.2; R is a mixture of $C_9$ to $C_{11}$ alkyl chains, n is 10 and m is 0), or mixtures thereof. Preferred herein are Dobanol $^R$ 91–10, or Dobanol $^R$ 45–7, Dobanol $^R$ 23–6.5, or mixtures thereof. These Dobanol $^R$ surfactants are commercially available from SHELL. Apart from the hydrophilic nonionic surfactants other hydrophilic surfactants may further be used in the emulsions of the present invention such as anionic surfactants described herein after.

The emulsions according to the present invention may further comprise other surfactants which should however not significantly alter the weighted average HLB value of the overall emulsion.

In a preferred embodiment of the emulsions of the present invention comprising said liquid hydrophobic bleach activator, the emulsifying system meets the equation:

$$HLB(X) = \frac{\%\ A}{100} \times HLB(A) + \frac{\%\ B}{100} \times HLB(B) \text{ and } \%\ A + \%\ B = 100\%;$$

where X refers to the hydrophobic ingredient to emulsify, if several hydrophobic ingredients are present X refers to all of them, A refers to one of said nonionic surfactants (hydrophilic or hydrophobic), and B refers to the other said nonionic surfactant (hydrophilic or hydrophobic).

In a particularly preferred embodiment of the emulsions of the present invention, wherein the emulsions comprise Acetyl triethyl citrate as the bleach activator, an adequate nonionic surfactant system would comprise a hydrophobic nonionic surfactant with for instance an HLB of 6, such as a Dobanol $^R$ 23–2 and a hydrophilic nonionic surfactant with for instance an HLB of 15, such as a Dobanol $^R$ 91–10. Other suitable nonionic surfactant systems comprise for example a Dobanol $^R$ 23–6.5 (HLB about 12) and a Dobanol $^R$ 23 (HLB below 6) or a Dobanol $^R$ 45–7 (HLB=11.6) and Lutensol $^R$ TO3 (HLB=8).

In the embodiment of the present invention where the peroxygen bleach-containing compositions of the present invention are formulated as microemulsions, said peroxygen bleach-containing microemulsions according to the present invention comprise a hydrophilic surfactant system comprising an anionic surfactant and a nonionic surfactant. A key factor in order to stably incorporate the hydrophobic activator is that at least one of said surfactants must have a significantly different HLB value to that of the hydrophobic activator. Indeed, if all said surfactants had the same HLB value as that of the hydrophobic activator, a continuous single phase might be formed thus lowering the chemical stability of the bleach/bleach activator system. Preferably, at least one of said surfactants has an HLB value which differs by at least 1.0 HLB unit, preferably 2.0 to that of said bleach activator.

Suitable anionic surfactants herein include water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$), $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate $C_{12}$–$C_{18}E(3.0)$, and $C_{12}$–$C_{18}$ alkyl polyethoxylate (4.0) sulfate $C_{12}$–$C_{18}E(4.0)M$), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Preferred surfactants for use in the microemulsions herein are the alkyl benzene sulfonates, alkyl sulfates, alkyl alkoxylated sulfates, and mixtures thereof. As mentioned hereinbefore, anionic surfactants provide improved cleaning performance. In addition, anionic surfactants herein, even at low levels, have shown to improve the physical stability of the microemulsions of the present invention, even at higher temperatures (up to 50° C.).

Suitable nonionic surfactants for use in the microemulsions herein include the hydrophilic nonionic surfactants as defined herein before for the emulsions.

The preferred making of the microemulsions of the present invention which comprises a liquid hydrophobic bleach activator includes premixing the surfactants with water and subsequently adding the other ingredients including hydrogen peroxide and said hydrophobic bleach activator. Irrespective of this preferred order of addition, it is important that during the mixing of the ingredients, the microemulsions be constantly kept under stirring under relatively high stirring energies, preferably 30 minutes at 750 rpm, most preferably 30 minutes at 1000 rpm.

In the embodiment of the present invention where the compositions are formulated as microemulsions said compositions are macroscopically transparent in the absence of opacifiers and dyes. In centrifugation examination, it was observed that said microemulsions herein showed no phase separation after 15 minutes at 6000 RPM. Under microscopic examination, said microemulsions appeared as a dispersion of droplets in a matrix. The matrix is the hydrophilic matrix described hereinbefore, and the droplets are constituted by the liquid hydrophobic bleach activator. We have observed that the particles had a size which is typically around or below 3 micron diameter.

The peroxygen bleach-containing compositions of the present invention may further comprise an amine oxide surfactant according to the formula R1R2R3NO, wherein each of R1, R2 and R3 is independently a C6–C30, preferably a C10–C30, most preferably a C12–C16 hydrocarbon chain. Indeed, we have observed that improved chemical stability, i.e., lower decomposition of the bleach and the bleach activator, if present, is obtained by adding such an amine oxide. It is believed that such stability is due to the capacity of the amine-oxide to limit interactions between the bleach and the bleach activator, if present, possibly through emulsification. It is believed that this stabilising effect is matrix independent. It has been further observed that in a pretreatment process, the presence of said amine oxide further improves the cleaning performance on particulate and/or greasy stains. It is believed that this improvement in cleaning performance is matrix independent. To obtain either of these benefits, amine oxides should be preferably present in amounts ranging from 0.1% to 10% by weight of the total composition, more preferably from 1% to 3%.

The peroxygen bleach-containing compositions of the present invention may further comprise up to 10%, preferably from 2% to 4% by weight of the total composition of an alcohol according to the formula HO—CR'R"—OH, wherein R' and R" are independently H or a C2–C10 hydrocarbon chain and/or cycle. Preferred alcohol according to that formula is propanediol. Indeed, we have observed that these alcohols in general and propanediol in particular also improve the chemical stability of the compositions, i.e. lower the decomposition of the bleach and the bleach activator, if present, as the amine oxides herein above. In addition, said alcohols lower the surface tension of the product, thus preventing superficial film or gel formation. Thus said alcohols improve the aesthetics of the compositions herein. It is believed that the chemical stabilising effect of said alcohols is twofold. Firstly they may work as radical scavengers and secondly they may interact with the hydrogen peroxide preventing or limiting hydrolysis, therefore reducing the rate of peroxide decomposition. It is believed that this improvement in chemical stability obtained by said alcohols is matrix independent.

The peroxygen bleach-containing compositions according to the present invention may further comprise a foam suppressors such as 2-alkyl alkanol, or mixtures thereof, as an optional ingredient. Particularly suitable to be used in the present invention are the 2-alkyl alkanols having an alkyl chain comprising from 6 to 16 carbon atoms, preferably from 8 to 12 and a terminal hydroxy group, said alkyl chain being substituted in the $\alpha$ position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol). Typically, the compositions of the present invention comprise up to 2% by weight of the total composition of a 2-alkyl alkanol, or mixtures thereof, preferably from 0.05% to 1.5% and most preferably from 0.1% to 0.8%.

The present invention further encompasses a process of pretreating soiled fabrics with a liquid composition comprising a peroxygen bleach and a polyamine as defined herein, or mixtures thereof, said process comprises the steps of applying said composition in its neat form onto the fabric and allowing said composition to remain in contact with said fabric preferably without leaving said composition to dry onto said fabric, before said fabric is washed. Said composition may remain in contact with said fabric, typically for a period of 1 minute to 24 hours, preferably 1 minute to 1 hour and more preferably 5 minutes to 30 minutes. Optionally, when the fabric is soiled with encrustated stains/soils which otherwise would be relatively difficult to remove, the compositions according to the present invention may be rubbed and/or brushed more or less intensively, for example, by means of a sponge or a brush or simply by rubbing two pieces of fabric each against the other.

By "washing" it is to be understood herein to simply rinse the fabrics with water, or the fabrics may be washed with conventional compositions comprising at least one surface active agent, this by the means of a washing machine or simply by hand.

By "in its neat form" it is to be understood that the compositions described herein are applied directly onto the fabrics to be pre-treated without undergoing any dilution, i.e. they are applied as described herein.

According to the process of pretreating soiled fabrics of the present invention, the liquid compositions used in said process should preferably not be left to dry onto the fabrics. Indeed, it has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabric, in the process of pretreating soiled fabrics according to the present invention, contributes to the benefits according the present invention, i. e. to reduce the tensile strength loss when pretreating fabrics with liquid peroxygen bleach-containing compositions.

Although preferred application of the compositions described herein is laundry pretreatment, the compositions according to the present invention may also be used as a laundry detergent or as a laundry detergent booster and as a household cleaner in the bathroom or in the kitchen, for the cleaning of dishes or carpets.

The present invention will be further illustrated by the following examples.

EXPERIMENTAL DATA

A) Stability test method

The following compositions were made by mixing the listed ingredients in the listed proportions (weight % unless otherwise specified).

| Compositions | I | II | III | IV | V | VI |
|---|---|---|---|---|---|---|
| Na Alkylsulphate | 2.0 | 2.0 | 2.0 | 2.0 | 2.0 | 2.0 |
| Dobanol ® 45-7 | 8.6 | 8.6 | 8.6 | 8.6 | 8.6 | 8.6 |
| Dobanol ® 23-3 | 6.4 | 6.4 | 6.4 | 6.4 | 6.4 | 6.4 |
| ATC | 3.5 | 3.5 | 3.5 | 3.5 | 3.5 | 3.5 |
| $H_2O_2$ | 6.0 | 6.0 | 6.0 | 6.0 | 6.0 | 6.0 |
| BHT | 0.05 | 0.05 | 0.05 | 0.05 | 0.05 | 0.05 |
| DTPA | 0.1 | 0.5 | — | — | — | — |
| DETPMP | — | — | 0.1 | 0.37 | — | — |
| Ethylene diamine | — | — | — | — | 0.5 | 1.2 |
| Water and minors | | | up to 100% | | | |
| H2SO4 up to pH 4 | | | | | | |
| Time requested for containers to bulge: | | | | | | |
| storage at 50° C. (days) | 4–6 | 2–3 | 10–12 | 6–7 | 14–16 | 21–24 |

ATC is acetyl triethyl citrate. BHT is di-tert-butyl hydroxy toluene marketed by shell under the trade name IONOL CP®. DTPA is diethylene triamine pentaacetate. DETPMP is diethylene triamine penta methylene phosphonate marketed by Monsanto under the trade name DEQUEST®.

Compositions VII VIII IX X

| Compositions | VII | VIII | IX | X |
|---|---|---|---|---|
| Na Alkylsulphate | 2.0 | 2.0 | 2.0 | 2.0 |
| Dobanol ® 45-7 | 8.6 | 8.6 | 8.6 | 8.6 |
| Dobanol ® 23-3 | 6.4 | 6.4 | 6.4 | 6.4 |
| ATC | 3.5 | 3.5 | 3.5 | 3.5 |
| $H_2O_2$ | 6.0 | 6.0 | 6.0 | 6.0 |
| BHT | 0.05 | 0.05 | 0.05 | 0.05 |
| Ethylene diamine | — | 0.5 | — | 0.5 |

-continued

| Compositions | VII | VIII | IX | X |
|---|---|---|---|---|
| Malonic acid | 1.5 | 1.5 | — | — |
| Salicylic acid | — | — | 2 | 1.5 |
| Water and minors | | | up to 100% | |
| H2SO4 up to pH 4 | | | | |
| Time requested for containers to bulge: | | | | |
| storage at 50° C. (days) | 3–4 | 5–6 | 8–10 | 13–15 |

ATC is acetyl triethyl citrate. BHT is di-tert-butyl hydroxy toluene marketed by shell under the trade name IONOL CP®.

Compositions I to IV are taken as reference, they comprise hydrogen peroxide and a given chelating agent such as diethylene triamine pentaacetate or diethylene triamine penta methylene phosphonate at different levels.

Compositions VII and IX are also taken as reference, they comprise hydrogen peroxide and as a chelating agent, malonic acid or salicylic acid.

Compositions V and VI are representative of the present invention, they comprise hydrogen peroxide and a polyamine as defined herein, i.e. ethylene diamine (EDA), at different levels. Compositions VIII and X are also representative of the present invention, they comprise hydrogen peroxide and a polyamine as defined herein, i.e. ethylene diamine (EDA), on top of chelating agents, i.e. malonic acid or salicylic acid.

A stability test method was carried out with the compositions I to X mentioned herein above. This test method was carried out by filling each of the compositions I to X into identical containers. The containers used were 250 ml bottles, of about 200 mm high, about 50 mm deep and about 60 mm wide. The thickness of the walls of the bottles ranged from 1 mm to 3 mm. The containers were closed with an air tight cap with a screw thread. To ensure air tightness during the test, silicone bands were added on the threads and caps were sealed with a tape. The filled and closed containers were then stored at 50° C. for the indicated periods. Each composition was tested in 6 different replicates. Bulging is evaluated by visual observation of rocker bottom on said containers.

Results are expressed in time requested for the containers to bulge (rocker bottom). Indeed, the first number of the results expressed herein before for the compositions I to X represents the time requested expressed in days, to observe rocker bottom on at least one of the 6 containers tested for a given composition and the second number of said results represents the time requested expressed in days to observe rocker bottom on all of the 6 bottles containers for said composition.

The above results clearly show that the peroxygen bleach-containing compositions of the present invention comprising a polyamine as defined herein, e.g. ethylene diamine, exhibit improved chemical stability. Indeed, the above results demonstrate that the time required to observe bulging (rocker bottom) of a given container under stressed conditions, i.e. storage at 50° C., is increased with the compositions of the present invention, as compared to the same compositions but without ethylene diamine, this both when ethylene diamine is used alone (compositions V and VI versus compositions I, II, III and IV) or on top of chelating agents (composition VIII versus composition VII and composition X versus composition IX).

B) Tensile strength test method:

The following compositions were made by mixing the listed ingredients in the listed proportions (weight % unless otherwise specified).

| Compositions | I | II | III | IV | V | VI |
|---|---|---|---|---|---|---|
| Na Alkylsulphate | 2.0 | 2.0 | 2.0 | 2.0 | 2.0 | 2.0 |
| Dobanol ® 45-7 | 8.6 | 8.6 | 8.6 | 8.6 | 8.6 | 8.6 |
| Dobanol ® 23-3 | 6.4 | 6.4 | 6.4 | 6.4 | 6.4 | 6.4 |
| ATC | 3.5 | 3.5 | 3.5 | 3.5 | 3.5 | 3.5 |
| $H_2O_2$ | 6.0 | 6.0 | 6.0 | 6.0 | 6.0 | 6.0 |
| BHT | 0.05 | 0.05 | 0.05 | 0.05 | 0.05 | 0.05 |
| DTPA | 1.5 | — | — | — | — | — |
| Malonic acid | — | — | 1.5 | 1.5 | — | — |
| Salicylic acid | — | — | — | — | 1.0 | 1.0 |
| Ethylene diamine | — | 1.5 | — | 0.5 | — | 0.5 |
| H2SO4 up to pH 4 | | | | | | |
| Water and minors | | | up to 100% | | | |
| Tensile strength loss (%) | 40 | 21 | 29 | 25 | 18 | 11 |

Pretreatment 24 hours Fabrics polluted with 30 ppm of copper per gram of fabric

ATC is acetyl triethyl citrate. BHT is di-tert-butyl hydroxy toluene marketed by shell under the trade name IONOL CP®. DTPA is diethylene triamine pentaacetate.

Composition I comprising 1.5% by weight of diethylene triamine pentaacetate is not stable, rocker bottom appears within 1 day only. Composition I is taken herein as a reference for tensile strength loss evaluation. Compositions III and V are further taken as reference, they comprise hydrogen peroxide and a chelating agent like salicylic acid or malonic acid. Compositions II, IV and VI are representative of the present invention they comprise hydrogen peroxide and ethylene diamine.

A tensile strength test method was carried out with the compositions mentioned herein above. This test method was carried out on metalpolluted fabrics. Indeed, cotton ribbons (dimension 12.5×5 $cm^2$) having a copper concentration of 30 ppm per gram of cotton were pre-treated according to the present invention. Indeed, the cotton ribbons were pretreated with 2 ml of each of the liquid compositions mentioned herein before. The compositions were left in contact with the ribbons for 24 hours, before being rinsed with water. After that, the damage on the fabrics, i.e. cotton ribbons, was evaluated by stretching said ribbons until they broke. The force necessary to break the ribbons, i.e. the Ultimate Tensile Stress, was measured, in wet conditions, with a Stress-Strain INSTRON Machine, model 4411. The lower the force needed to break said cotton ribbons, the more serious is the damage caused on the fabrics. A good confidence (standard deviation=2–4 Kg) on the results is obtained using five replicates for each test.

The tensile strength loss mentioned above for the different compositions tested is expressed in percentage and is obtained by comparing the tensile strength of a given fabric taken as a reference, i.e. a fabric which has not been pre-treated, to the tensile strength of the same fabric measured after said fabric has been pre-treated as mentioned herein before.

The above results clearly show the unexpected fabric safety improvement, i.e. reduction of tensile strength loss, obtained by using liquid compositions according to the present invention comprising a peroxygen bleach and a polyamine, e.g. ethylene diamine, as compared to the use of the same compositions but without said polyamine, this both when used alone (composition II versus composition I) or on top of chelating agents (composition IV versus composition III and composition VI versus composition V). Indeed, the tensile strength loss is reduced when pretreating fabrics with compositions according to the present invention, this even upon a long contact period, i.e. 24 hours and in presence of a high concentration of copper on the surface of said fabrics, i.e. 30 ppm per gram of cotton fabric.

Example

Following composition were made by mixing the listed ingredients in the listed proportions (weight % unless otherwise specified).

| Compositions | I | II | III | IV | V | VI |
|---|---|---|---|---|---|---|
| $H_2O_2$ | 6.0 | 6.0 | 6.0 | 7.0 | 7.0 | 6.0 |
| ATC | 3.5 | 3.5 | 3.5 | — | — | 3.5 |
| Alkylsulphate (1) | 12 | 12 | 12 | 2 | 2 | 2 |
| Dobanol ® 23-3 | 12 | 12 | 12 | — | 3 | — |
| Dobanol ® 45-7 | — | — | — | 3 | — | 15 |
| Ethylene diamine | 1.0 | 0.5 | 0.5 | 1.0 | 0.5 | 0.5 |
| Salicylic acid | — | 1.0 | — | — | 1.0 | 1.0 |
| Malonic acid | — | — | 1.0 | — | — | — |
| Water and minors (dye) | | | up to 100% | | | |
| $H_2SO_4$ up to pH 4 | | | | | | |

The compositions in the examples are according to the present invention. The tensile strength loss is reduced when pretreating fabrics with compositions I to VI, even when leaving said compositions to act onto the fabrics upon a prolonged contact period, i.e., 24 hours, before washing said fabrics and in the presence of high concentration of metal ions on the surface of the fabrics, e.g. about 30 ppm of copper per gram of cotton fabric.

Also when using said compositions I to VI for pretreating colored fabrics no color change and/or discoloration were observed.

These compositions undergo no more than 3% available oxygen loss when stored for prolonged period of time 20 days at 50° C.

What is claimed is:

1. A stable liquid composition comprising;

(a) from about 0.01% to about 90% by weight of the total composition of a peroxygen bleach;

(b) from about 0.01% to about 5.0% by weight of the total composition of a polyamine which is a member selected from the group consisting of polyamines having one of the following general structures:

$NH_2—(CH_2—CH_2—NH)_n—CH_2—CH_2—NH_2$ wherein n is an integer of from 0 to 15, $NH_2—(CH_2—CH_2—NH)_n(CH2\text{-}CH_2—CH_2—NH)_mCH_2—CH_2—NH_2$ wherein n is an integer of from 0 to 8, and m is an integer of from 0 to 8, $C_nH_{2n+2-m}(NH_2)_m$ wherein n is an integer of from 2 to 20, and m is an integer of from 2 to 4, $C_nH_{2n-m}(NH_2)_m$ wherein n is an integer of from 2 to 20, and m is an integer of from 2 to 4, $C_nH_{2n-2-m}(NH_2)_m$ wherein n is an integer of from 3 to 20, and m is an integer of from 2 to 4, $C_nH_{2n-4-m}(NH_2)_m$ wherein n is an integer of from 4 to 20, and m is an integer of from 2 to 4, $C_nH_{2n-6-m}(NH_2)_m$ wherein n is an integer of from 5 to 20, and m is an integer of from 2 to 4, and mixtures thereof; and (c) a member selected from the group consisting of malonic acid and salicylic acid, wherein said composition has a pH of from 0 to about 6.

2. A liquid composition according to claim 1 wherein said polyamine is selected from the group consisting of ethylene diamine, propylene diamine, isopropylene diamine, 1,2-alkyl diamines, 1,3-alkyl diamines, 1,4 alkyl diamines and mixtures thereof.

3. A composition according to claim 1 wherein said liquid composition comprises from about 0.1% to about 3% by weight of the total composition of said polyamine or mixtures thereof.

4. A composition according to claim 1 wherein said peroxygen bleach is hydrogen peroxide or a water soluble source thereof, or mixtures thereof.

5. A composition according to claim 1 wherein said composition comprises from about 2% to about 20% by weight of the total composition of said peroxygen bleach.

6. A composition according to claim 1 which further comprises a member selected from the group consisting of diethylene triamine methylene phosphonate, ethylene N,N'-disuccinic acid, diethylene triamine pentaacetate, glutamic acid, glycine, substituted mono and di-hydroxy benzenes and their analogs, alkyl and aryl carboxylates and mixtures thereof.

7. A composition according to claim 6 wherein said composition further comprises a liquid hydrophobic bleach activator in amounts of from about 0.5% to about 20% by weight of the total composition.

8. A composition according to claim 7, said composition being formulated as a microemulsion of said hydrophobic liquid bleach activator in a matrix comprising water, said peroxygen bleach and a hydrophilic surfactant system comprising an anionic and a nonionic surfactant.

9. A composition according to claim 7, wherein at least one of said surfactants in said system has an HLB value that differs by at least 1 HLB unit, to that of said bleach activator, and wherein said composition optionally further comprises from about 0.1% to about 10% by weight of the total composition, of an amine oxide according to the formula R1R2R3NO, wherein each of R1, R2 and R3 is independently a C6–C30, hydrocarbon chain and up to about 10% by weight of the total composition, of an alcohol according to the formula HO—CR'R"—OH, wherein R' and R" are independently H or a C2–C10 hydrocarbon chain and/or cycle, or mixtures thereof.

10. A composition according to claim 7, said composition being formulated as an aqueous emulsion comprising at least a hydrophilic surfactant having an HLB above about 10, and at least a hydrophobic surfactant having an HLB up to about 9, wherein said hydrophobic bleach activator is emulsified by said surfactants.

11. A composition according to claim 7, said composition being formulated as an aqueous emulsion comprising at least a hydrophilic nonionic surfactant having an HLB above about 11 and at least a hydrophobic nonionic surfactant having an HLB below about 9, wherein said hydrophobic bleach activator is emulsified by said surfactants.

12. A process of pretreating soiled fabrics with a liquid composition according to claim 1, said process comprising the steps of applying said composition in its neat form onto the fabric, and allowing said composition to remain in contact with said fabric before said fabric is washed.

13. A composition according to claim 7 wherein said composition further comprises a liquid acetyl triethyl citrate, in amounts of from about 0.5% to about 20% by weight of the total composition.

14. A method for pretreating a soiled fabric before said fabric is washed, for reducing the loss of tensile strength in said fabric comprising contacting said fabric with the liquid composition claimed in claim 1.

15. A method for pretreating a soiled colored fabric before said colored fabric is washed, for reducing the color damage of said fabric comprising contacting said colored fabric with the liquid composition claimed in claim 1.

* * * * *